United States Patent [19]

White, Jr.

[11] 4,181,294

[45] Jan. 1, 1980

[54] COOLING PLATES FOR A FURNACE

[76] Inventor: Herbert A. White, Jr., 2516 Collins Rd., Pittsburgh, Pa. 15235

[21] Appl. No.: 14,051

[22] Filed: Feb. 22, 1979

[51] Int. Cl.[2] ..... C21B 7/10

[52] U.S. Cl. ..... 266/194

[58] Field of Search ..... 266/194

[56] References Cited

U.S. PATENT DOCUMENTS

| | | | |
|---|---|---|---|
| 1,703,520 | 2/1929 | Dorel | 266/194 |
| 3,593,975 | 7/1971 | White, Jr. | 266/194 |

*Primary Examiner*—M. J. Andrews

*Attorney, Agent, or Firm*—Martin J. Carroll

[57] ABSTRACT

A cooling plate for a furnace having a refractory lining surrounded by a steel shell having an opening therethrough includes a box embedded in the refractory lining and having a front opening closed by a front plate. A flange extends radially outwardly around the front of the box with its front surface matching the rear surface of the front plate. A collar surrounds the box between the flange and the steel shell. A plurality of sets of aligned holes are provided in the front plate, flange and collar with at least the holes in the collar being threaded. A cap screw passing through each set of aligned holes and threaded into the collar not only secures the front plate to the box but also secures the cooling plate to the furnace.

7 Claims, 3 Drawing Figures

COOLING PLATES FOR A FURNACE

This invention relates to cooling plates and more particularly to cooling plates for blast furnace linings such as shown in my prior U.S. Pat. No. 3,593,975 dated July 20, 1971. As shown therein this includes a box which is preferably a casting having an open front end which is closed by a steel plate. The cooling plate has the advantages which are set forth, but in operation have some disadvantages. The plate may be welded to the steel shell of the furnace or may be secured to the shell by a keeper bar assembly as shown in the patent. The first alternative prevents removal of the plate for inspection of the box and the keeper bar assembly is relatively expensive and subject to damage. In both alternatives the joint between the box and plate is located within the furnace shell. Thus if a water leak develops between the steel plate and box harmful water can be introduced into the furnace without the operator's knowledge.

It is therefore an object of my invention to provide a two part cooling plate including a front plate and box wherein the joint between the two parts is so located that any water leakage at the joint can be readily detected.

Another object is to provide such a cooling plate having improved means for fastening it to the furnace shell.

Still another object is to provide such a cooling plate in which the front plate can be readily removed for inspection of the box and/or removal of the entire cooling plate without damage to the front plate.

A further object is to provide such a cooling plate which may be readily replaced while the furnace is in operation.

These and other objects will be more apparent after referring to the following specification and attached drawings in which.

Figure 1:
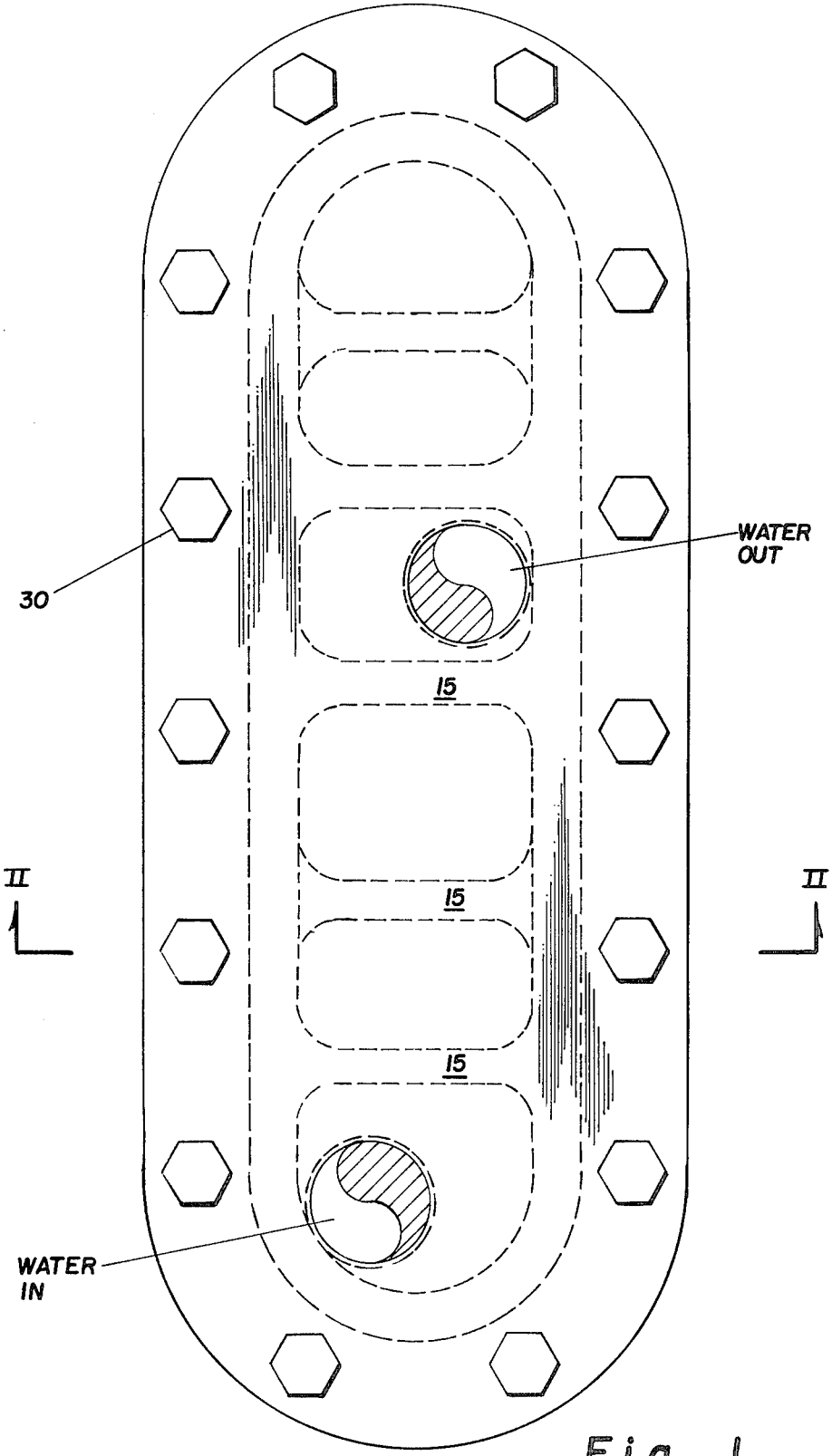
FIG. 1 is a front elevation of the cooling plate.
Figure 2:
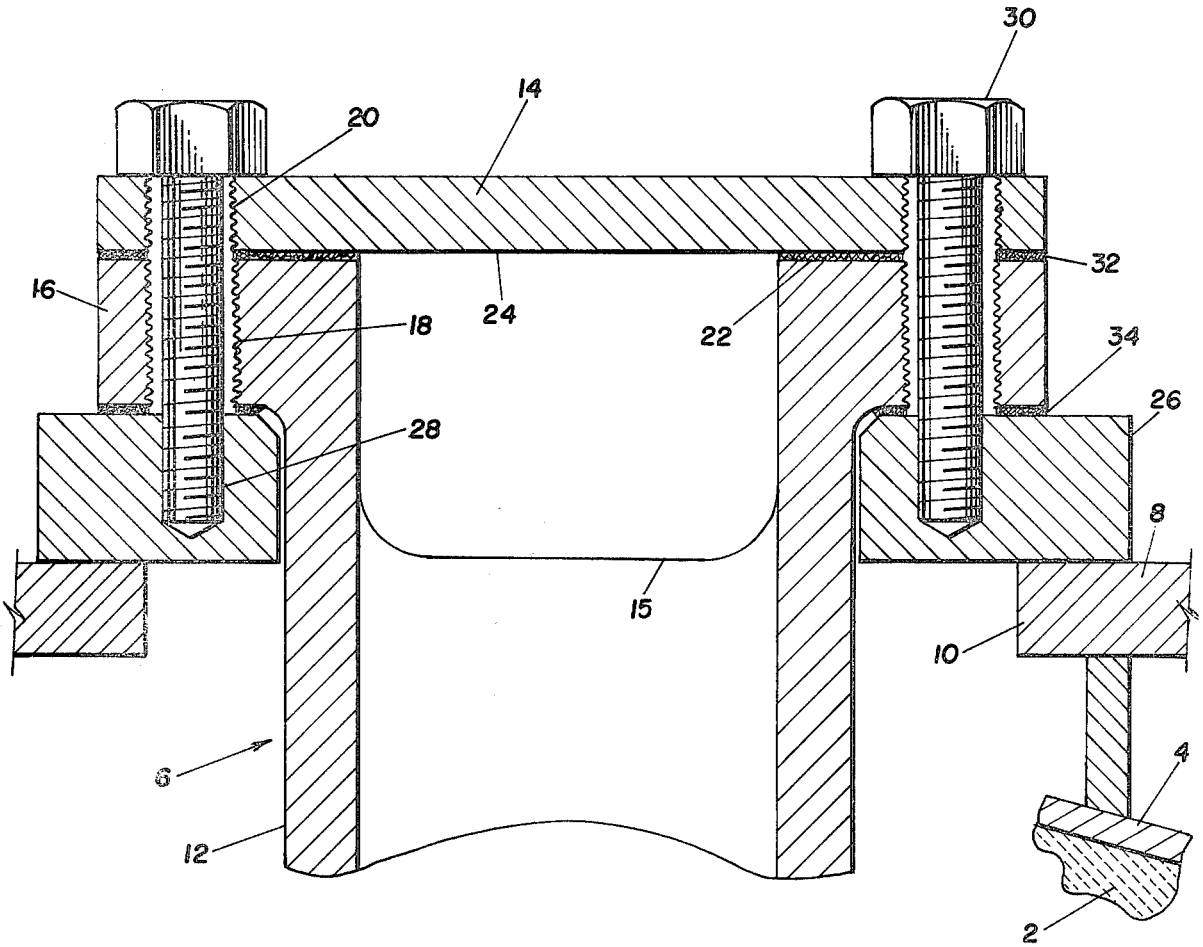
FIG. 2 is a sectional view taken on line II—II of FIG. 1.

Referring more particularly to FIGS. 1 and 2 of the drawings reference numeral 2 indicates the refractory wall of a blast furnace having a steel shell 4 surrounding its outer periphery. It will be understood that a very large number of cooling plates 6 are provided for each furnace but only one is shown in detail. A plate holder 8 is generally provided for each cooling plate and has an opening 10 therethrough.

The cooling plate 6 includes a water tight box 12 and a front plate 14. The box 12 is basically the same as that of my prior patent and may be fabricated or cast from various metals with partitions 15 therein. It is preferred that it be a copper or copper alloy casting. However, it differs from that of the patent in that it has an outwardly extending flange 16 on the front end of the box instead of the lugs shown in the patent. A plurality of spaced apart holes 18 extend through the flange 16 around its periphery. The front plate 14 which is preferably made of steel has holes 20 around its periphery, one in alignment with each hole 18. Outer surface 22 of the box 12 matches the inner surface 24 of plate 14. A collar 26, preferably of steel, surrounds the box 12 and is preferably welded to the plate holder 8 or the plate holder 8 may be omitted and the collar welded directly to the shell 4. Threaded holes 28 are provided in collar 26, one aligned with each hole 18. The holes 18 are preferably threaded to a larger size than holes 28. For example, the holes 28 may have a ½ inch thread and the holes 18 a ⅝ inch thread. In such case the holes 20 would be of such size as to receive a ⅝ inch cap screw 29. The holes 18 and 20, on the other hand, may simply be of such size as to receive a ½ inch cap screw, but this latter arrangement lacks some benefits of the first arrangement. While hole 20 is shown as threaded the same as hole 18 it is preferred that it be unthreaded.

In assembly, with the collar welded in place, ½ inch cap screws 30 are passed through holes 18 and 20 with a water tight gasket 32 between box 12 and plate 14 and a gas tight gasket 34 abutting the furnace end of flange 16. The box 12 is then inserted into the furnace and the cap screws 30 threaded into holes 28. The refractory is then placed in the usual manner and water connections made.

It will also be understood that the collar 26 may be assembled with the other parts before being welded or otherwise attached to the shell 4. It will also be understood that the cooling plate could be attached to the collar in other ways, even permanently such as by welding the steel to the collar. However, permanent attachment loses many of the advantages of my invention. It will be further understood that the term "stud" is used in its broad sense to include any threaded member having means at its outer end to hold the plate 14 in place.

During operation of the furnace a water leak may occur at the joint between box 12 and plate 14 or it may be desired to inspect the inside of the box 12. In either case this requires removal of plate 14 which may be readily done by removal of the studs 30. A new gasket 32 can be installed in case of a leak at the joint.

Figure 3:
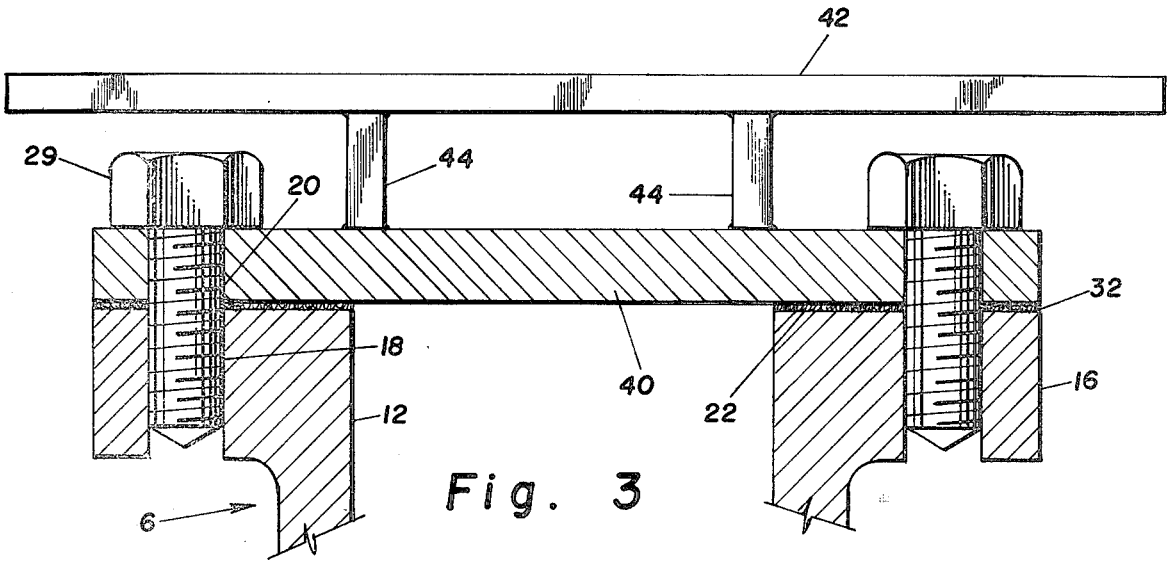
FIG. 3 is a sectional view, similar to FIG. 2, but showing the steel front plate replaced by a pulling plate.

In some instances it becomes necessary to replace a cooling plate which has a hole burnt through its box or is otherwise damaged. In such a case the water is shut off and a pulling plate 40 (FIG. 3) replaces end plate 14. This plate is generally the same as plate 14 except that it is provided with a second plate 42 attached thereto in spaced relationship by means of members 44. In the example of ½ inch studs and hole arrangement set forth above ⅝ inch studs 29 are inserted through some of the holes 20 threaded into corresponding holes 18. By means of a jack or hammer, force is applied to plate 42 to remove the cooling plate box 12.

In replacing a burnt out cooling plate with a new one it is necessary to have water flowing through it when being inserted. This is accomplished by passing ⅝ inch studs 29 into some of the aligned holes 18 and 20 with the studs being threaded into holes 18. This is done with the cooling plate 14 outside of the furnace opening and the water is supplied to the cooling plate at this time. The cooling plate is then inserted as originally except that the ½ inch studs are used first only in those holes not having ⅝ inch studs therein. Only after installation of the cooling plate are the ⅝ inch studs removed and replaced by the ½ inch studs. It will be understood that other size studs may be used, it only being necessary that the permanent studs be longer and smaller in diameter than the other studs. With a close enough fit gaskets 32 and 34 may be omitted.

While one embodiment has been shown and described in detail, it will be readily apparent to those skilled in the art that various adaptations and modifications may be made within the scope of the invention.

I claim:

1. In a furnace wall including a refractory lining, an outer steel shell having an opening therethrough, cooling apparatus extending through said opening and means securing said cooling apparatus to said steel shell, said cooling apparatus including a front plate, a water tight box having an opening in its front end, means detachably securing said box to said front plate with the front plate closing the front opening in said box, said front end opening extending over the majority of the area of the front end so as to permit visual inspection of the inside of said box when said front plate is removed, means for supplying coolant through said front plate into said box, and means for removing coolant from said box through said front plate; the improvement in said cooling apparatus including an outwardly extending flange on the front end of said box having a front surface matching the rear surface on said front plate, said means securing said front plate to said box and said cooling apparatus to said shell including a plurality of spaced apart holes extending through said flange, holes through said front plate one aligned with each of said holes in said flange, collar means surrounding said box between said flange and said shell and attached to said shell, and means extending through each of said aligned holes and attached to said collar means.

2. Apparatus according to claim 1 in which said collar means has a plurality of threaded holes therein one in alignment with each of said holes in said flange, and said means extending through said aligned holes is a cap screw threaded into the aligned hole in said collar.

3. Apparatus according to claim 2 including a plate holder secured to said shell around the opening therein, and said collar means is welded to said plate holder.

4. Apparatus according to claim 2 in which the holes in said flange are threaded to a larger diameter than said cap screw, and the holes in said front plate are of such size as to permit passage of a member to be screwed into said holes in said flange.

5. Apparatus according to claim 4 including a plate holder secured to said shell around the opening therein, and said collar means is welded to said plate holder.

6. Apparatus according to claim 1 including water sealing means between said flange and said front plate, and gas sealing means between said flange and said collar.

7. Apparatus according to claim 1 in which said front plate is made of steel, and said box is a copper containing casting.

* * * * *